United States Patent [19]

Spielman

[11] Patent Number: 4,814,986

[45] Date of Patent: Mar. 21, 1989

[54] DEVICE FOR MONITORING RELATIVE POINT OF IMPACT OF AN OBJECT IN FLIGHT PROXIMAL A REFERENCE LINE ON A SURFACE

[76] Inventor: Daniel A. Spielman, 2037 Pine St., Philadelphia, Pa. 19103

[21] Appl. No.: 43,797

[22] Filed: Apr. 28, 1987

[51] Int. Cl.[4] ..... G06F 15/44

[52] U.S. Cl. ..... 364/410; 273/29 A; 273/31; 340/323 R

[58] Field of Search ..... 273/29 A, 31, 411; 364/410, 411; 340/323 R

[56] References Cited

U.S. PATENT DOCUMENTS

| | | | |
|---|---|---|---|
| 2,113,899 | 4/1938 | Oram | 250/222.1 |
| 2,142,378 | 1/1939 | Sachtleben | 255/41.5 |
| 2,547,332 | 4/1951 | Loveless et al. | 177/384 |
| 2,783,957 | 3/1957 | O'3 Neil et al. | 244/110 |
| 3,025,406 | 3/1962 | Stewart et al. | 250/221 |
| 3,436,540 | 4/1969 | Lamorlette | 250/83.3 |
| 3,488,510 | 1/1970 | Raymond, Jr. et al. | 250/222 |
| 3,516,065 | 6/1970 | Bolt et al. | 333/116 X |
| 3,532,886 | 10/1970 | Kruger, Jr. et al. | 250/83.3 |
| 3,596,103 | 7/1971 | Matthews et al. | 250/221 |
| 3,739,372 | 6/1973 | Schlisser et al. | 340/258 B |
| 3,746,863 | 7/1973 | Pronovost | 250/208 |
| 3,825,916 | 7/1974 | Steele et al. | 340/258 B |
| 3,856,302 | 12/1974 | Karkoska | 273/55 R |
| 3,889,118 | 6/1975 | Walker | 250/341 |
| 3,982,759 | 9/1976 | Grant | 273/31 |
| 3,989,246 | 11/1976 | Brown et al. | 273/29 R |
| 4,004,805 | 1/1977 | Chen et al. | 273/29 R |
| 4,074,117 | 2/1978 | DeLorean et al. | 235/92 T |
| 4,092,634 | 5/1978 | Von Kohorn | 273/31 X |
| 4,116,437 | 9/1978 | Johnson | 273/29 A |
| 4,247,768 | 1/1981 | Elmer et al. | 250/222 R |
| 4,249,074 | 2/1981 | Zettler et al. | 250/221 |
| 4,272,189 | 1/1981 | Bailey et al. | 356/28 |
| 4,375,289 | 3/1983 | Schmall | 273/411 X |
| 4,422,647 | 12/1983 | Wilson et al. | 273/411 |
| 4,432,058 | 2/1984 | Supran | 370/323 X |
| 4,503,399 | 3/1985 | Carr | 340/573 |
| 4,528,548 | 7/1985 | Oberan | 340/323 R |

FOREIGN PATENT DOCUMENTS

| | | | |
|---|---|---|---|
| 2025241 | 1/1980 | United Kingdom | 273/31 |

*Primary Examiner*—Jerry Smith
*Assistant Examiner*—Steven G. Kibby
*Attorney, Agent, or Firm*—Panitch Schwarze Jacobs & Nadel

[57] ABSTRACT

A device for monitoring the relative point of impact of an object in flight proximal a reference line on a surface. The reference line may be imaginary or it may be visually perceptible. In a preferred application, the reference line is the outer edge of a game court boundary stripe such as the service box stripe or the base line stripe on a tennis court. At least one plane of radiated energy, preferably light beams, is pre-positioned with respect to the reference line. Detectors, preferably photodetectors, provide data signals indicative of the relative elevation of the object at two successive points in time based on intersection of at least one plane of radiated energy by the object. A programmed microcomputer determines whether the point of surface impact is to one side or another of the reference line, or coincident with the reference line, based on the data signals. The microcomputer commands an annunciator to provide an audible or visual indication of the determination.

17 Claims, 7 Drawing Sheets

FIG. 12 (a)
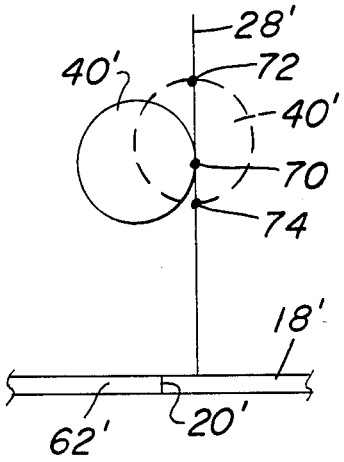
FIG. 12 (b)
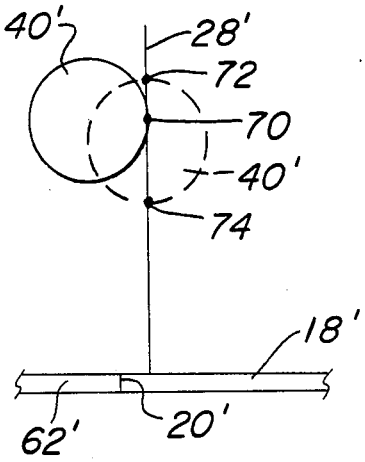
FIG. 13 (a)
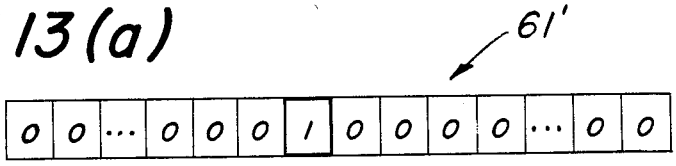
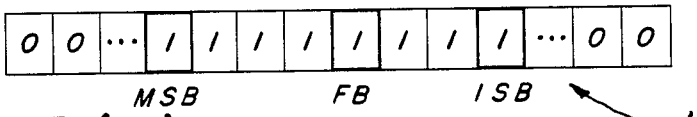
FIG. 13 (b)

DEVICE FOR MONITORING RELATIVE POINT OF IMPACT OF AN OBJECT IN FLIGHT PROXIMAL A REFERENCE LINE ON A SURFACE

BACKGROUND OF THE INVENTION

The present invention is directed generally to a device for monitoring the relative point of impact of an object in flight proximal a reference line on a surface. In many applications, it is important to determine whether an object in flight has impacted a surface on a reference line or on one side of the reference line or another. The reference line may be an imaginary line or it may be a line which is visually perceptible. The dimensions of the object, its speed, and distance between the point of impact and the point of observation and the angle of observation may preclude a visual determination of the point of impact by a human observer.

This problem may be encountered in various recreational games which employ a game court defined by boundary markers for example, the games of handball, basketball, baseball, soccer, football and tennis, all of which employ game courts defined by boundary markers in the form of stripes having predetermined widths. Each edge of such a boundary stripe may be considered a reference line. In such applications, a game ball may strike the game court surface proximal an edge of the boundary stripe, making it difficult or impossible to determine whether the ball has landed "in bounds" or "out of bounds". In the game of tennis, a game ball is considered "out of bounds" only if the ball strikes no part of the game court including the boundary stripe. The boundary stripe may be the service box stripe or the base line stripe. The unaided human eye may be unable to determine the point of surface impact of the ball proximal the outer edge of the boundary stripe due to dimensions of the ball, the speed of the ball, and the distance from and angle at which the point of surface impact must be observed.

The purpose of the present invention is to provide a device for monitoring the point of impact of an object in flight proximal a reference line such as the outer edge of a game court boundary stripe, which device is reliable, relatively inexpensive to construct and operate, and which determines whether the point of surface impact of the object is on one side of the reference line or the other by a simple algorithm.

BRIEF SUMMARY OF THE INVENTION

A device for monitoring the relative point of impact of an object in flight proximal a reference line on a surface comprising means for forming at least one plane of radiated energy, preferably light beams, the plane being pre-positioned with respect to the reference line. The device includes means, preferably photodetectors, for detecting relative elevation of the object at two successive points in time based on intersection of at least one plane of radiated energy by the object and for generating data representative of the relative elevations, and means for generating a signal indicative of whether the point of surface impact of the object is on the reference line or is to one side of the reference line or the other based on the data. Preferably, the means for generating the signal is a programmed microcomputer which commands an audible or visual annunciator.

For the purpose of illustrating the invention, there is shown in the drawings forms which are presently preferred; it being understood, however, that this invention is not limited to the precise arrangements and instrumentalities shown.

BRIEF DESCRIPTION OF THE DRAWINGS

FIGS. 12*a* and *b* shows an object intersecting a single plane of light pre-positioned with respect to the reference line.

FIGS 13*a* and *b* shows the bit patterns and the microcomputer buffer, as the object traverses a single plane of light as shown in FIG. 12.

DETAILED DESCRIPTION OF INVENTION

Figure 1:
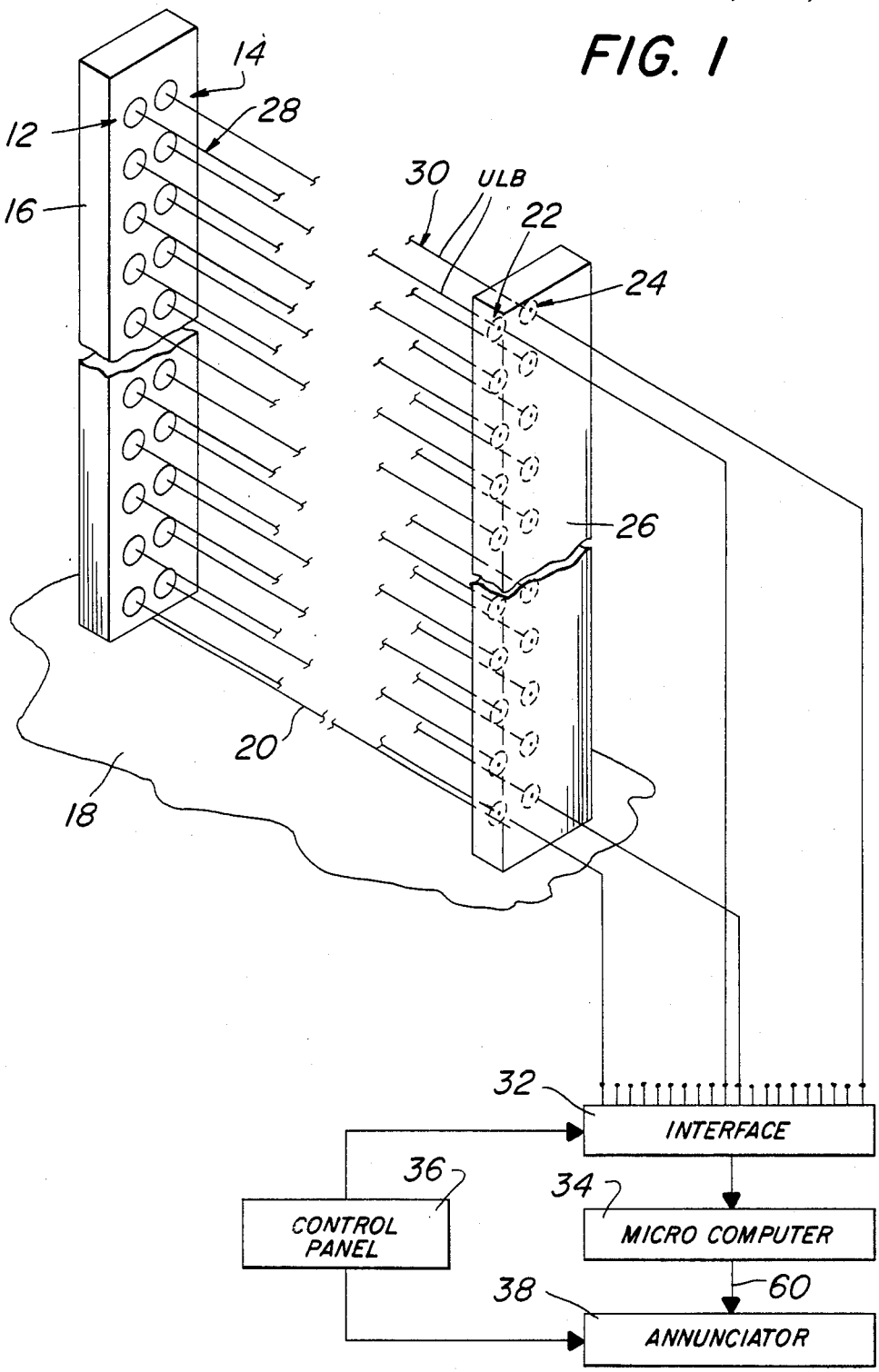
FIG. 1 is a hybrid schematic and block diagram of the monitoring device of the present invention.

Referring to the drawings, wherein like numerals indicate like elements, there is shown in FIG. 1 a device for monitoring the relative point of impact of an object in flight proximal a reference line on a surface according to the present invention, designated generally as 10. Like spaced vertical columns of infrared light emitting laser diodes 12, 14 are housed in a support 16 on surface 18. The columns 12, 14 are closely spaced and straddle a reference line 20 on surface 18. Reference line 20 may be an imaginary line or a visually perceptible line. In the preferred application of the invention, reference line 20 is the outer edge of a tennis court boundary stripe such as the service box stripe or base line stripe. Preferably, each column 12, 14 of laser diodes is spaced identically from reference line 20.

Like, spaced vertical columns of photodetectors 22, 24 are mounted in a support 26 on surface 18. The columns 22, 24 also straddle reference line 20, each one being spaced identically from the reference line. Each laser diode in column 12 (14) is aligned with a corresponding photodetector in column 22 (24). Each laser diode produces a collimated infrared light beam parallel to reference line 20. Each such beam is coincident on and is detected by the corresponding photodetector in column 22 (24). The light beams generated by the column 12 of laser diodes define a light plane designated 28 in FIG. 1. The light beams generated by the column 14 of laser diodes define a light plane designated 30 in FIG. 1. Preferably, the light planes are parallel to each other and the reference line 20.

The output of each photodetector in columns 22 and 24 is connected via an interface 32 to a programmed microcomputer 34. The interruption of any light beam in planes 28 or 30 is detected by the associated photodetector in columns 22 or 24 whereupon the photodetector generates an output or data signal which is transmitted via interface 32 to the microcomputer 34. A control panel 36 provided with a bank of switches enables or disables the microcomputer at the user's option. The microcomputer 34 commands an annunciator 38 which may be an audible annunciator such as a two tone generator or an optical annunciator such as a pair of LEDs (one tone or LED for each microcomputer command). The control panel switches may also be used to enable or disable the annunciator at the user's option. Thus, in certain situations it may be desirable to disable the annunciator while the microcomputer is enabled to generate the annunciator commands.

Figure 2:
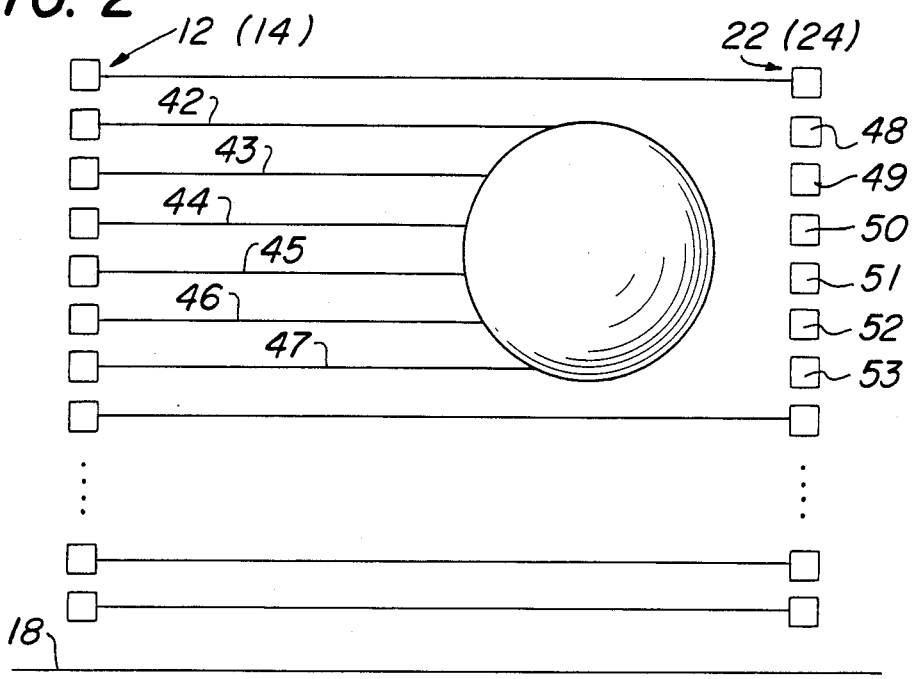
FIG. 2 shows a symmetrical object, such as a tennis ball, intersecting a plane of light according to the invention.
Figure 3:
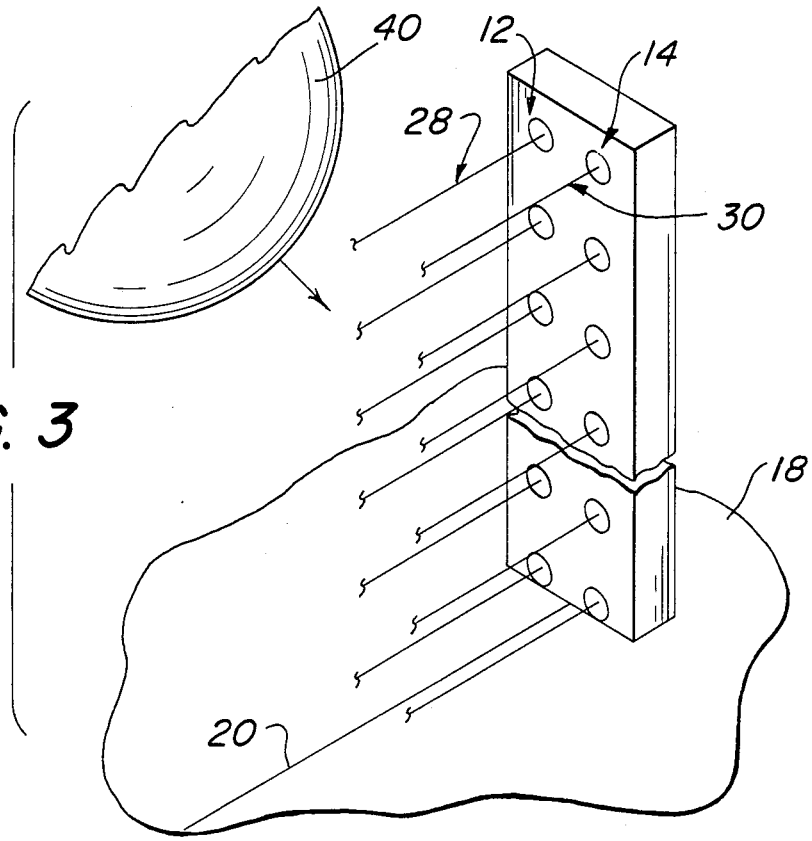
FIG. 3 shows the planes of light straddling a reference line in the form of the outer edge of a tennis court boundary stripe.

Adjacent laser diodes in each column 12 or 14 are vertically spaced by a uniform distance equal to a fraction of a dimension of the object in flight. Preferably, adjacent photodetectors in each column 22 or 24 are vertically spaced by the same uniform distance. The spacing between adjacent laser diodes in a column is chosen based on the detection resolution desired. For example, as shown in FIG. 2, the object in flight is a symmetrical object such as a tennis ball. A tennis ball has a diameter of between approximately 2.5 and 2.625 inches. Adjacent laser diodes in each column 12 or 14 could therefore be spaced apart (center-to-center) by one-fourth or one-fifth of the ball diameter, i.e., between approximately 0.626 and 0.656 inches or between approximately 0.5 and 0.525 inches. The spacing between the light planes may be some multiple of the diode (or detector) spacing and may vary. For a given diode (or detector) spacing, enhanced performance may be achieved by increasing the spacing between light planes so long as the approximation of straight lines of flight is preserved between the planes. Preferably, the spacing between the light planes is four to five times the spacing between adjacent detectors.

As the object 40 traverses light plane 28 (30) in FIG. 2, it interrupts light beams at a particular region in the plane. In FIG. 2, for example, light beams 42, 43, 44, 45, 46 and 47 are interrupted by object 40 as it traverses the light plane. The particular sequence in which the object 40 interrupts the light beams 42–47 is of no significance in the preferred embodiment of the invention described herein. Photodetectors 48, 49, 50, 51, 52 and 53 sense the interruption of light beams 42–47, respectively, and generate output or data signals indicating the same on interface input lines 54, 55, 56, 57, 58 and 59. The output or data signals are merely binary signals which indicate interruption or no-interruption of the light beam associated with each photodetector. Since each interface input line is uniquely associated with a photodetector, the data indicates the region of elevation of the object 40 with respect to surface 18 as the object traverses the light plane.

Figure 4:
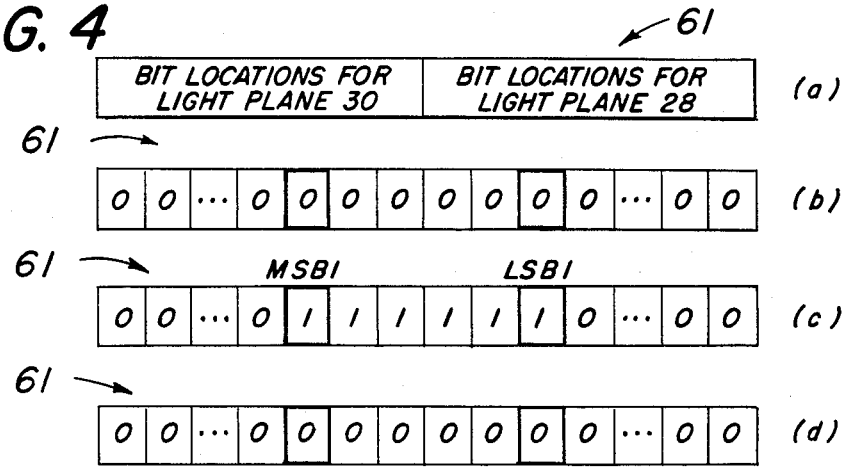
FIG. 4 shows the bit patterns in the microcomputer buffer as the object traverses a plane of light as shown in FIG. 2.

The data signals are transmitted via interface 32 to microcomputer 34 and are stored as bits ("1"s and "0"s) in a dynamic buffer (register) 61 in the microcomputer as shown schematically in FIG. 4(*a*). Each bit location in the buffer is assigned to one photodetector data signal. One-half of the buffer is reserved for the photodetectors of one light plane, and the other half is reserved for the photodetectors of the other light plane. The bit locations in each half of the buffer are ordered identically from a least significant bit to a most significant bit. Alternatively, two separate buffers may be employed, one for each light plane.

When a photodetector detects an interrupted light beam, it generates a data signal which is converted to a binary "1" bit and stored in the buffer at the bit location assigned to the photodetector. Otherwise, the photodetector generates a data signal which is converted to a binary "0" bit and stored at the assigned bit location in the buffer. Thus, the pattern of bits stored in the buffer will change as an object traverses each light plane.

Referring to FIG. 4(*b*), there is shown one-half of the buffer which is reserved for the photodetectors of light plane 28. All bit locations contain binary "0"s indicating that an object is not intersecting the light plane. As an object traverses the light plane, however, it intersects a number of light beams. The number of interrupted light beams increases from one to a maximum of six for the object and photodetector spacing shown in FIG. 2. The maximum is reached when the object is bisected by the light plane. As the object continues through the light plane, the number of interrupted light beams decreases from six to one. When the object has passed through the light beam, the number of interrupted beams is zero. While each light beam is interrupted, it results in the storage of a binary "1" bit at the assigned bit location in the buffer. In FIG. 4(*c*), there is shown the bit pattern in the buffer as the object interrupts light beams 42–47 in FIG. 2, i.e., as the object is being bisected by the light plane. In FIG. 4(*d*), there is shown the bit pattern in the buffer when the object has passed through the light plane.

Figure 10:
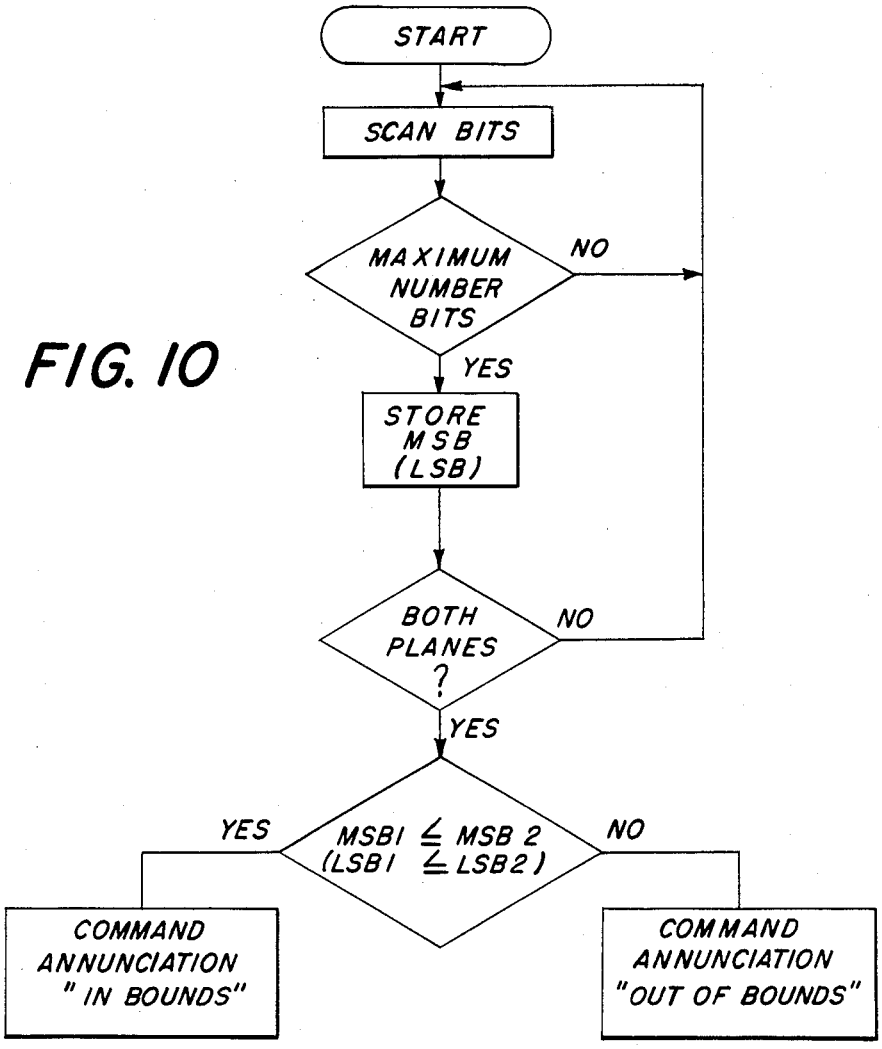
FIG. 10 is a flow chart showing operation of the microcomputer in FIG. 1.

Referring to FIG. 10, the microcomputer executes an algorithm based on the buffer bit pattern to obtain an indication of the relative elevation of the object 40 as it traverses each light plane. The microcomputer continuously scans the buffer 61 to determine whether an object has intersected a single light beam, as would be indicated by a binary "1" bit at a bit location in the buffer. If a binary "1" is detected, the microcomputer commences a count of the number of binary "1"s appearing in the buffer. The microcomputer continues to scan the buffer, maintaining a count of the numbers of binary "1"s appearing in the buffer as the bit pattern changes. Thus, the count changes dynamically with the bit pattern. The microcomputer detects a maximum count of the numbers of "1"s as the bit pattern changes and stores in memory a binary number (MSB1) indicative of the most significant bit location containing a binary "1" at the time the maximum count was reached. The most significant bit location containing a binary "1" represents the uppermost light beam intersected by the object. The microcomputer then repeats the process as the object intersects the next light plane, and it stores a binary number (MSB2) indicative of the bit location representing the uppermost light beam intersected in that plane. The two numbers MSB1 and MSB2 represent the elevation of the object at each light plane. The numbers are compared by the microcomputer to determine the relative position of the point of impact of the object proximal the reference line. If MSB1 is less than or equal to MSB2, the microcomputer commands the annunciator to provide a signal indicating that the point of impact is on or to one side of the reference line. If MSB1 is greater than MSB2, the microcomputer commands the annunciator to provide a signal indicating that the point of impact is to the other side of the reference line.

The same procedure can be employed to annunciate the same conditions by using the least significant bit location containing a binary "1" in the buffer. Thus, the least significant bit location containing a binary "1", when the count reaches a maximum number of "1"s, represents the lowermost light beam intersected by the object and is therefore indicative of the elevation of the object as it traverses the light plane. The same comparison can therefore be made by the microcomputer to determine the relative position of the point of impact of the object proximal the reference line. Thus, if the binary number LSB1 represents the least significant bit location containing a binary "1" as the object traverses the first light plane, and the binary number LSB2 represents the least significant bit location containing a binary "1" as the object traverses the second light plane, then the microcomputer compares the two numbers to determine whether LSB1 is less than or equal to LSB2. If LSB1 is less than or equal to LSB2, the microcomputer commands the annunciator to provide a signal indicating that the point of impact is on or to one side of the reference line. If LSB1 is greater than LSB2, the microcomputer commands the annunciator to provide a signal indicating that the point of impact is to the other side of the reference line. Thus, in the preferred embodiment, whether using most or least significant bits, the sequence in which light beams of the same plane are interrupted by the object can be ignored by the microcomputer. The time lapse between plane-to-plane interruptions can also be ignored.

Figure 5:
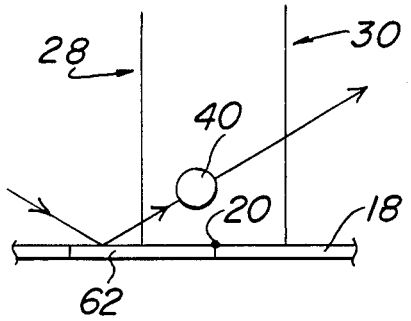
FIGS. 5–9 show the geometries for various points of impact of an object such as a tennis ball proximal a reference line straddled by the light planes.
Figure 6:
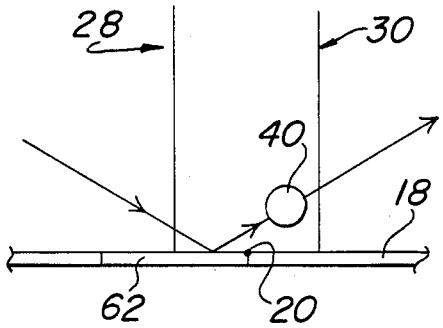
Figure 7:
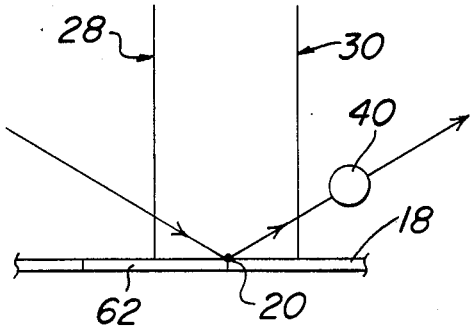

The microcomputer 34 is programmed to command the annunciator 38 over output line 60 (which may actually be two signal lines) according to the foregoing algorithm. The algorithm accounts for each of the flight path conditions shown in FIGS. 5–9 and described hereafter. These conditions presume a symmetrical object and substantially straight lines of flight of the object proximal the light planes, and an angle of incidence which is substantially equal to the angle of reflection or rebound of the object. FIGS. 5–7 show three conditions wherein the object 40 impacts surface 18 on or on one side of reference line 20. If reference line 20 is the outer edge of a boundary stripe 62 on surface 18, these conditions represent a game ball impacting the game court surface "in bounds". For example, stripe 62 may be the service box boundary stripe for a tennis court. In FIG. 5, object 40 impacts surface 18 proximal reference line 20 and rebounds so as to traverse light planes 28 and 30 in an ascending path. In FIG. 6, object 40 impacts surface 18 between light plane 28 and reference line 20 whereby the object intersects plane 28 along a descending path and plane 30 along an ascending path. In FIG. 7, object 40 impacts surface 18 on reference line 20, mid-way between light planes 28 and 30 whereby the object intersects light plane 28 along a descending path and light plane 30 along an ascending path. For each of the conditions shown in FIGS. 5–7, object 40 intersects light plane 28 at an elevation which is less than or equal to the elevation at which it intersects light plane 30. For these conditions, the microcomputer determines that MSB1 (or LSB1) is less than or equal to MSB2 (or LSB2) and generates a command signal (over one of the signal lines 60) which actuates annunciator 38 so as to indicate to the observer (umpire) that the object has impacted surface 18 to one side of reference line 20 or directly on the reference line. If reference line 20 is the edge of a tennis court service box stripe 62, or the edge of a tennis court baseline stripe, the annunciator indicates that the ball has landed "in bounds".

Figure 8:
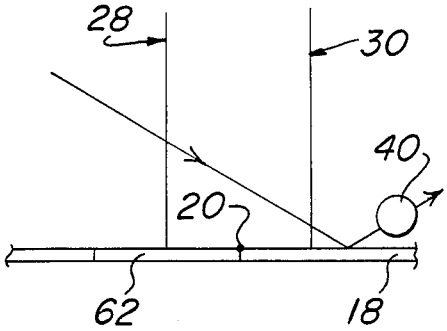
Figure 9:
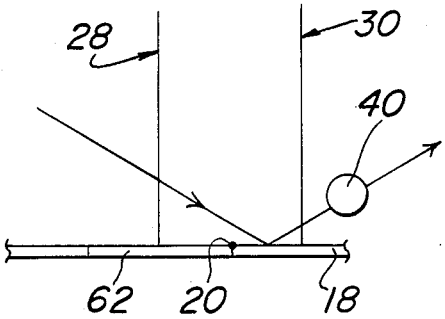

In FIGS. 8 and 9, object 40 is shown striking surface 18 on the other side of reference line 20. In FIG. 8, object 40 impacts surface 18 beyond light plane 30. The object traverses both light planes 28, 30, along a descending path. In FIG. 9, object 40 impacts surface 18 between reference line 20 and light plane 30. The object traverses light plane 28 along a descending path and light plane 30 along an ascending path. In both conditions shown in FIGS. 8 and 9, object 40 traverses light plane 28 at a higher elevation than the elevation at which the object traverses light plane 30. For these conditions, the microcomputer determines that MSB1 (or LSB1) is greater than MSB2 (or LSB2) and generates a command signal (over the other one of the signal line 60) such that annunciator 38 indicates to the observer (umpire) that the object has impacted surface 18 on the opposite side of reference line 20. If reference line 20 is the edge of a tennis court service box stripe 62, or the edge of a tennis court baseline stripe, this indicates that the tennis ball has landed "out of bounds".

Figure 11:
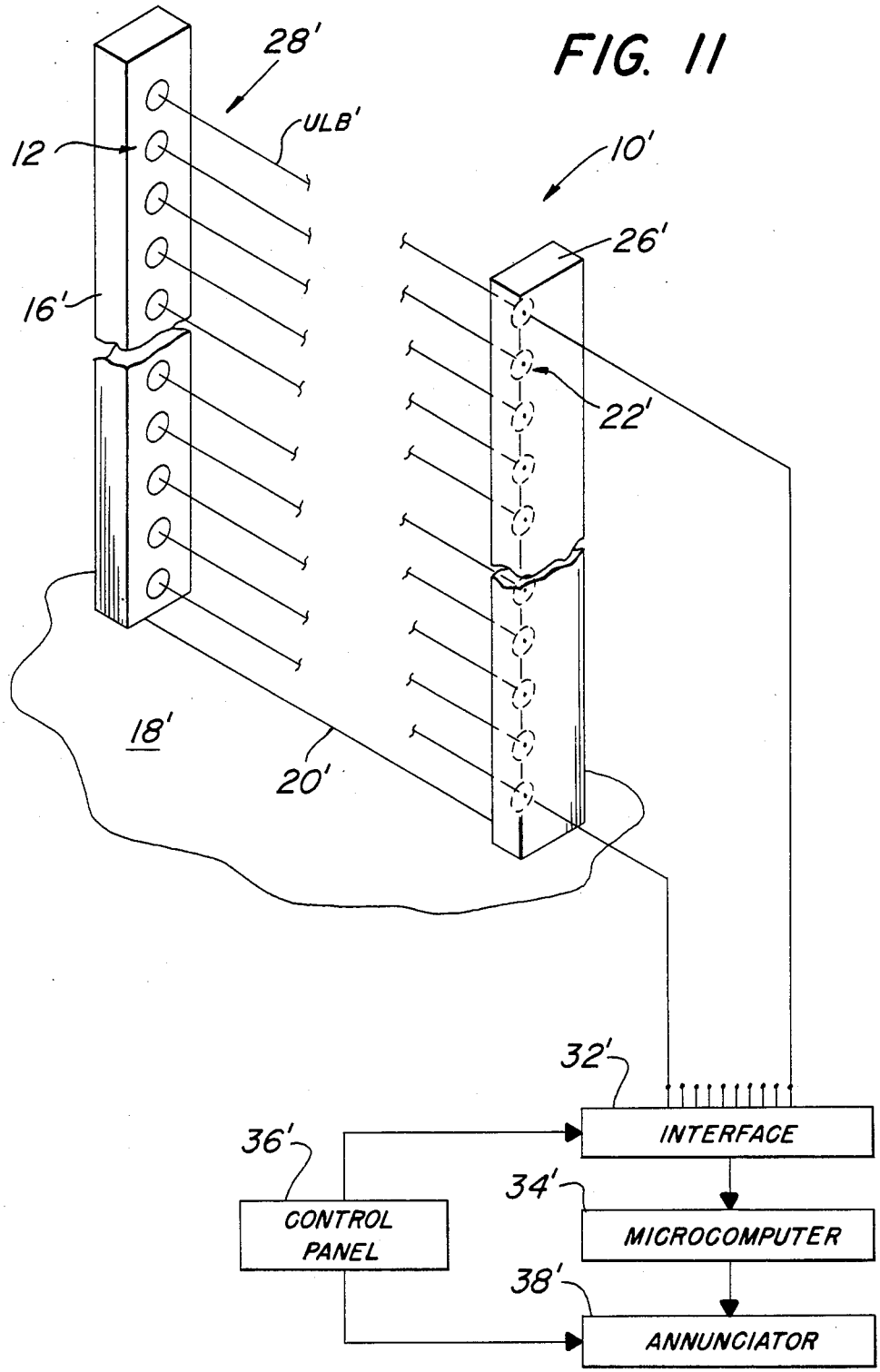
FIG. 11 is a hybrid schematic and block diagram of an alternate embodiment of the monitoring device of the present invention.
Figure 14:
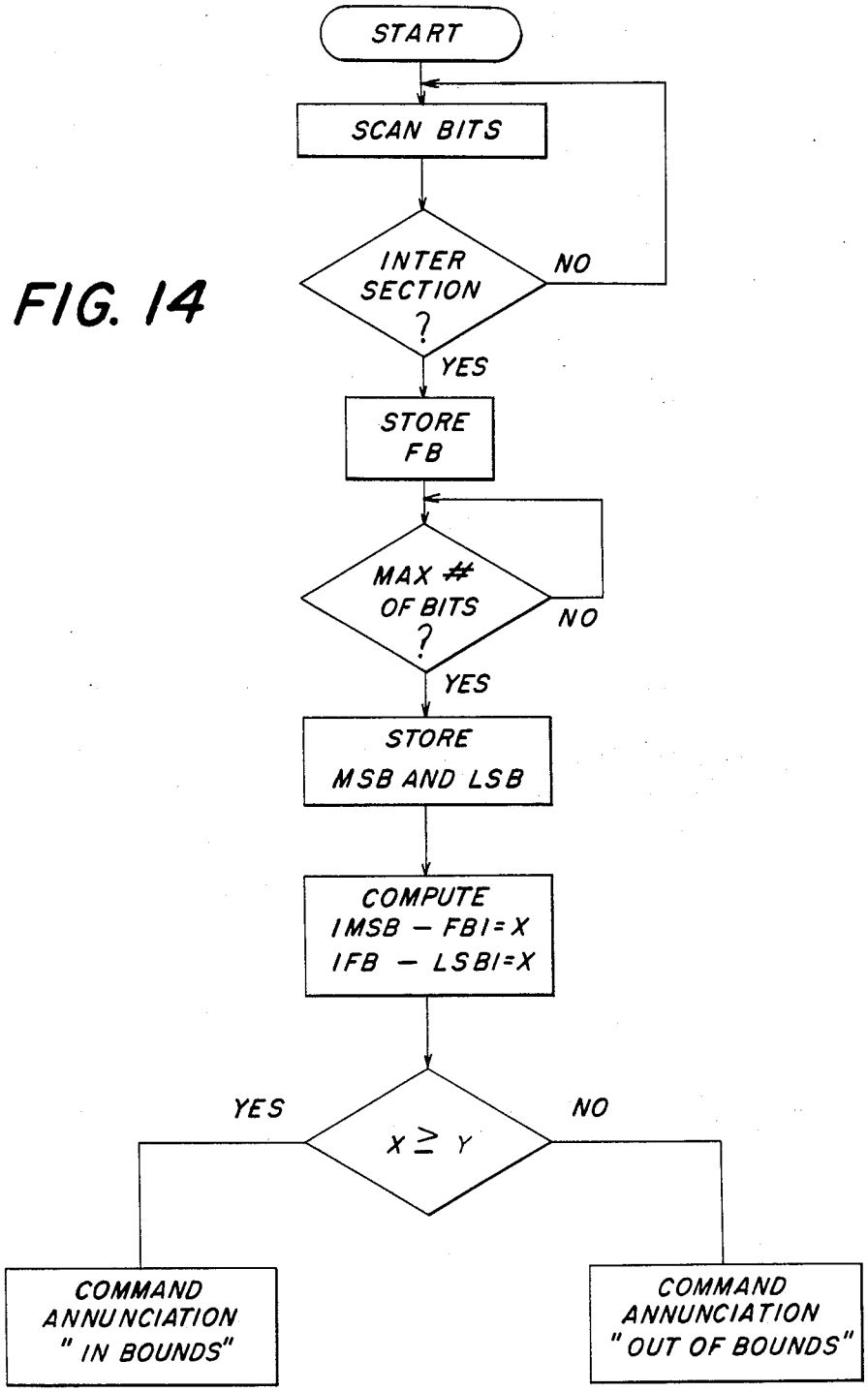
FIG. 14 is a flow chart showing operation of the microcomputer in FIG. 11.

Referring to FIG. 11, there is shown an alternate embodiment of the invention designated generally as 10'. A single vertical column of infrared light emitting laser diodes 12' is housed in a support 16' on surface 18'. A column of photodetectors 22' is mounted in a support 26' on surface 18'. Each laser diode in column 12' is aligned with a corresponding photodetector in column 22'. Each laser diode produces a collimated infrared light beam parallel to reference line 20'. Each such beam is coincident on and is detected by the corresponding photodetector at column 22'. The light beams generated by the column 12' of laser diodes define a light plane designated 28' in FIG. 11. Adjacent laser diodes in column 12' (and adjacent photodetectors in column 22') are vertically spaced by a uniform distance as previously described in connection with embodiment 10 of the invention shown in FIG. 1.

The output of each photodetector in column 22' is connected via an interface 32' to programmed microcomputer 34'. The interruption of any light beam in plane 28' is detected by the associated photodetector in column 22' where upon the photodetector generates an output or data signal which is transmitted by interface 32' to microcomputer 34'. Control panel 36' separately enables or disables microcomputer 34' and an annunciator 38' commanded by the microcomputer.

Columns 12' and 22' are aligned relative to reference line 20' so as to produce a plane of light beams parallel to the reference line but spaced a predetermined distance from the reference line along surface 18' (to the right in FIG. 12). If the light plane is centered on the reference line or is spaced beyond the reference line (to the right in FIG. 12) by less than one-half the radius of the object, the object may strike the surface on or before the reference line (to the left in FIG. 12) and produce a spurious result. If the light plane is spaced beyond the reference line (to the right in FIG. 12) by more than one-half the radius of the object, the object may strike the surface between the reference line and a line spaced in front of the plane (to the left in FIG. 12) by one-half the radius of the object and produce a spurious result. Accordingly, the spacing between the plane and reference line is preferably one-half the radius of the object.

As the object 40' traverses light plane 28', it interrupts light beams at a particular region in the plane as schematically represented in FIG. 12. Again, substantially straight lines of flight and substantially equal angles of incidence and reflection or rebound are presumed. If the object 40' traverses light plane 28' in an ascending path (or even a horizontal path) it may be assumed that the point of impact of the object on surface 18 is to the left of reference line 20 in FIG. 12(*a*). If the path of the object 40' as it traverses light plane 28' is descending, it can be assumed that the point of impact of the object with surface 18' is to the right of reference line 20' as shown in FIG. 12(*b*).

As the object 40' first intersects the light plane, it interrupts a single light beam designated generally as 70. Light beam 70 may be any one of the light beams in the plane. As the object traverses the light plane, it intersects an increasing number of light beams. The maximum number of light beams interrupted by the object occurs when the object is bisected by the light plane. For this condition, the uppermost and lowermost light beams interrupted by the object are designated generally as 72 and 74 in FIG. 12. If the spacing between light beams 70 and 72 is greater than or equal to the spacing between light beams 70 and 74, this indicates that the flight path of the object is ascending as it traverses the light plane, and may be taken as an indication that the point of impact on surface 18' is to the left of the reference line 20'. See FIG. 12(*a*). If the spacing between light beams 70, 72 is less than the spacing between light beams 70, 74, this indicates that the flight path of the object is descending as it traverses the light plane, and may be taken as an indication that the point of impact on surface 18' is to the right of reference light 20'.

The photodetectors in column 22' produce output or data signals as previously described in connection with embodiment 10 shown in FIG. 1. The data signals are transmitted by interface 32 to microcomputer 34' and are stored as bits in a dynamic buffer 61' in the microcomputer as shown schematically in FIG. 13. Each bit location in the buffer is assigned to one photodetector data signal. The bit locations are ordered from a least significant bit to a most significant bit. The pattern of bits stored in the buffer will change as an object traverses the light plane as previously described.

As the object first intersects the light plane, it interrupts light beam 70. While the light beam is interrupted, it results in the storage of a binary "1" bit at the assigned bit location in the buffer as shown in FIG. 13(*a*). The microcomputer continuously scans the buffer and maintains a dynamically changing count of the number of binary "1"s appearing in the buffer as previously described. When light beam 70 is interrupted by the object, the microcomputer detects the binary "1" at the assigned bit location and stores in memory a binary number (FB) indicative of the bit location. The microcomputer continues to scan the buffer, maintaining a changing count of the numbers of binary "1"s appearing in the buffer as the bit pattern changes. The microcomputer detects a maximum count of the numbers of "1"s as the bit pattern changes, as previously described, and stores in memory the binary number (MSB) indicative of the most significant bit location containing a binary "1" at the time the maximum count was reached. The most significant bit location containing a binary "1" represents the uppermost light beam interrupted by the object as it is being bisected by the light plane. The microcomputer also stores in memory a binary number (LSB) indicative of the least significant bit location containing a binary "1" at the time the maximum count was reached. The least significant bit location containing a binary "1" represents the lowermost light beam interrupted by the object as it is being bisected by the light plane. Each of the bit locations are shown in FIG. 13(*b*).

The microcomputer then effects a computation of the spacing between light beams 70, 72, i.e., the absolute value of MSB-FB. The microcomputer also computes the spacing between light beams 70, 74, i.e., the absolute value of FB-LSB. The computations are then compared. If the computation of the spacing between light beams 70, 72 is greater than or equal to the computation of spacing between the light beams 70, 74, indicating an ascending flight path or a horizontal flight path, the microcomputer commands the annunciator to provide a signal indicating that the point of impact is to the left of reference line 20' as shown in FIG. 12. If the computation of the spacing between light beams 70, 72 is less than the computation of the spacing between light beams 70, 74, indicating a descending flight path, the microcomputer commands the annunciator to provide a signal indicating that the point of impact is to the right of the reference line 20' in FIG. 12. If reference line 20' is the edge of a tennis court service box stripe 62', or the edge of a tennis court base line stripe, the signal indicates that the ball has landed "in bounds" or "out of bounds" as previously described.

In the preferred embodiment of the invention described herein, the light emitting laser diodes produce highly coherent beams of light. If desired, however, additional optics may be provided to ensure accurate focusing of each light beam on its associated photodetector. In addition, the laser diodes may be modulated as is well-known to increase detection sensitivity and to reject interference from extraneous light sources, and each diode may be modulated at a different frequency to prevent spillover or cross-talk between adjacent laser diode-photodetector pairs.

Although the invention has been described in terms of light planes, each defined by a co-planar array of collimated light beams, it should be understood that other sources of energy may also be employed in practicing the invention. For example, the laser diode-photodetector pairs may be replaced by other energy source-detector pairs such as ultrasonic emitters and detectors. Thus, in its broadest sense, the invention is directed to a device for monitoring the relative point of impact of an object in flight proximal a reference line on a surface utilizing at least one plane of radiated energy which is pre-positioned with respect to the reference line, and detectors for detecting relative elevation of the object at two successive points in time based on intersection of at least one plane of radiated energy by the object. The sequence in which the beams of a plane are intersected is effectively ignored as is the time lapse between plane-to-plane intersections (when two planes are employed). The numbers of energy source-detector pairs in a plane, and the spacing between adjacent sources and between adjacent detectors, are chosen to provide the desired resolution and accuracy.

It should be appreciated that the invention is particularly suited for monitoring the relative point of surface impact of a symmetrical object, such as a game ball. If the device is being used to determine whether a game ball has landed "in bounds" or "out of bounds", it may be necessary to provide the device with the capability of distinguishing between a game ball and a spurious object such as a small stone or a player's foot or a tennis racket. Thus, if the device is used to determine whether a ball has landed "in bounds" or "out of bounds" proximal the outer edge of the baseline stripe of a tennis court, it can be expected that the player's foot will traverse the light planes in some situations before the tennis ball reaches the area of the baseline stripe. Discrimination between the tennis ball and a spurious object based on size can be accomplished as follows.

The microcomputer 34 (34') is programmed to scan the buffer 61 (61') and maintain a count of the number of interrupted light beams as an object traverses a light plane, as previously described. The count is maximum when the object is being bisected by the light plane. A pair of constants each representative of a maximum count of interrupted light beams provide an upper and lower limit of an acceptable size of the object in terms of numbers of light beams. These constants are stored in microcomputer ROM. The microcomputer compares the maximum count to each constant. A small stone or a player's foot or a tennis racket traversing a light plane will more than likely interrupt a number of light beams outside the range defined by the stored constants. If so, the microcomputer ignores the object and generates no command for the annunciator. Otherwise, the microcomputer operates as previously described to command the annunciator.

In addition, the uppermost light beam ULB (ULB') in each plane (FIGS. 1 and 11) may be utilized to avoid an erroneous call if a small portion of a player's foot or a small portion of a tennis racket intersect a light plane and produce a maximum count within the range of the stored constants. In this case, a bit location corresponding to the uppermost beam ULB (ULB') would not be utilized in the buffer. A small portion of a player's foot or a small portion of a player's racket which skims the top of a light plane would interrupt at least the uppermost light beam ULB (ULB'). Any interruption of the uppermost light beam ULB (ULB') would be detected by the microcomputer, and the microcomputer would generate no command for the annunciator.

It should be understood that, when applying the device to determine "in bounds" or "out of bounds" calls in the game of tennis, the device will make no determination unless the tennis ball intersects a light plane (FIG. 11) or both light planes (FIG. 1). Each light plane may extend a vertical distance of approximately two feet from the surface. A tennis ball which lands well within the service box boundaries, and not proximal the reference line 20 (20'), may not intersect the light plane (FIG. 11) or both light planes (FIG. 1). However, in that case, the point of surface impact relative to the reference line should be readily detectable by the human eye. Similarly, a tennis ball which lands well outside the service box boundaries may not intersect the light plane (FIG. 11) or both light planes, but in that case the point of surface impact relative to the reference line should be readily detectable by the human eye. Thus, an observer (umpire) should require assistance only for a ball which lands proximal the reference line. In those cases where the observer can determine the point of impact with certainty by visual observation, the annunciator need not be enabled. Thus, although the microcomputer would be enabled to generate the annunciator commands, the annunciator would not respond unless enabled by the observer (via the control panel). In those cases where the point of impact cannot be determined with certainty by visual observation, the observer may enable the annunciator via the control panel to obtain assistance in making the "in bounds" or "out of bounds" call.

The present invention may be embodied in other specific forms without departing from the spirit or essential attributes thereof and, accordingly, reference should be made to the appended claims, rather than to the foregoing specification, as indicating the scope of the invention.

I claim:

1. Device for monitoring the relative point of impact with a surface of an object in flight proximal a reference line on said surface, comprising:

means for forming one or more planes of radiated energy, said one or more planes being pre-positioned with respect to a reference line on a surface, means for detecting relative elevation of an object in flight at two successive points in time based on intersection of at least one plane of radiated energy by the object and for generating data representative of the relative elevation of the object at each point in time, and means for generating a signal indicative of whether the point of surface impact of the object is to one side of said reference line or the other based on the difference in said elevation.

2. Device for monitoring relative point of impact with a surface of an object in flight proximal a reference line on said surface, comprising:

means for forming one plane of radiated energy, said plane be pre-positioned with respect to a reference line on a surface, means for detecting relative elevation of an object in flight at two successive points in time based on intersection of said plane of radiated energy by the object and for generating data representative of the relative elevation of the object at each point in time, and means for generating a signal indicative of whether the point of surface impact of the object is to one side of said reference line or the other based on the difference in said elevations.

3. Device for monitoring the relative point of impact with a surface of an object in flight proximal a reference line on said surface, comprising:

means for forming at least two non-intersecting planes of radiated energy, said planes being pre-positioned so as to straddle a reference line on a surface, means for detecting relative elevation of an object in flight at two successive points in time based on intersection of each of said planes of radiated energy by the object and for generating data representative of the relative elevation of the object at each plane, and means for generating a signal indicative of whether the point of surface impact of the object is to one side of said reference line or the other based on said data.

4. Device according to claim 1, 2 or 3 wherein each plane of radiated energy is substantially parallel to the reference line.

5. Device according to claim 4 wherein each plane of radiated energy is substantially perpendicular to the surface.

6. Device according to claim 1, 2 or 3 wherein each plane of radiated energy is a plane of non-intersecting light beams.

7. Device according to claim 1, 2 or 3 wherein said object is symmetrical.

8. Device according to claim 7 wherein said object is a tennis ball.

9. Device according to claim 7 wherein the object has a diameter of between approximately 2.5 and 2.625 inches.

10. Device according to claim 1, 2 or 3 wherein the surface is a game court surface and said reference line is an edge of a game court boundary stripe.

11. Device according to claim 10 wherein said game court surface is a tennis court surface and said reference line is the edge of a service box boundary stripe.

12. Device according to claim 10 wherein said game court surface is a tennis court surface and said reference line is the edge of a base line boundary stripe.

13. Device according to claim 1, 2 or 3 including means for discriminating between different sized objects intersecting a plane of radiated energy and for disabling said signal generating means based on the object size.

14. Device according to claim 13 including means for detecting an intersection as a predetermined region of a plane of radiated energy by the object and for disabling said signal generating means based on said last-mentioned detection.

15. Device according to claim 14 wherein said predetermined region of a plane is defined by a single light beam.

16. Device according to claim 2 wherein said plane is spaced from said reference line by a distance proportional to a dimension of the object.

17. Device according to claim 16 wherein said object is a tennis ball and said plane is spaced from said reference line by one-half the radius of the tennis ball.

* * * * *